US005725146A

United States Patent [19]

Luberto

[11] Patent Number: 5,725,146

[45] Date of Patent: Mar. 10, 1998

[54] BOX WITH RAISED STRUCTURALLY ENHANCED TOP COVER HAVING VENT OPENINGS

[75] Inventor: Michael Dominick Luberto, Edgewater, N.J.

[73] Assignee: Arnold Berson, Hackensack, N.J.; a part interest

[21] Appl. No.: 738,043

[22] Filed: Oct. 25, 1996

[51] Int. Cl.[6] ..... B65D 5/66

[52] U.S. Cl. ..... 229/120; 229/131; 229/152; 229/906

[58] Field of Search ..... 229/120, 131, 229/152, 178, 902, 906, 915

[56] References Cited

U.S. PATENT DOCUMENTS

| | | | |
|---|---|---|---|
| 1,334,932 | 3/1920 | Gray | 229/131 |
| 1,578,598 | 3/1926 | Zareko | 229/131 |
| 2,114,823 | 4/1938 | Toscano | 229/120 |
| 2,319,018 | 5/1943 | Ullman . | |
| 2,643,812 | 6/1953 | Lange . | |
| 2,801,785 | 8/1957 | Manizza | 229/131 |
| 3,163,344 | 12/1964 | Tunick | 229/120 |
| 3,307,770 | 3/1967 | Wysocki | 229/131 |
| 3,462,062 | 8/1969 | Miller | 229/915 |
| 4,264,031 | 4/1981 | Goebel . | |
| 4,344,537 | 8/1982 | Austin | 229/120 |
| 4,765,534 | 8/1988 | Zion et al. . | |
| 4,804,136 | 2/1989 | Hall . | |
| 5,263,634 | 11/1993 | Korine . | |
| 5,326,022 | 7/1994 | Green . | |
| 5,385,292 | 1/1995 | Labianca et al. | 229/120 |

FOREIGN PATENT DOCUMENTS

| | | | |
|---|---|---|---|
| 1357708 | 3/1964 | France | 229/131 |
| 83/00476 | 2/1983 | WIPO | 229/120 |

*Primary Examiner*—Gary E. Elkins
*Attorney, Agent, or Firm*—Richard M. Goldberg

[57] ABSTRACT

A pizza box includes a bottom wall; a peripheral side wall attached to a periphery of the bottom wall; a top cover including a rear edge hingedly attached to the side wall, a front edge, two side edges between the front edge and the rear edge, two slits in the top cover, each slit extending from a front edge, side edge or corner to an inner point of the top cover and each slit formed by a first slit section which is offset from a second slit section thereof, a first fold line interconnecting the inner points of the top cover to form a lift flap between the first fold line and the two slits, two second fold lines extending from the first fold line toward the rear edge, the top cover being bent along the first and second fold lines such that the first fold line defines a highest position of the top cover with the remainder of the cover sloping down therefrom toward the edges of the cover, and a vent opening which is always open is formed along each of the slits; and a rear connecting panel which connects the top cover to the peripheral side wall via a double hinge.

20 Claims, 4 Drawing Sheets

BOX WITH RAISED STRUCTURALLY ENHANCED TOP COVER HAVING VENT OPENINGS

BACKGROUND OF THE INVENTION

The present invention is directed to cardboard boxes, and more particularly, is directed to a shallow box for holding a pizza pie.

Boxes for holding pizza pies are well-known in construction. Such boxes have a bottom wall, a peripheral side wall attached to a periphery of the bottom wall and a hinged top cover. The top cover has downwardly extending side panels which fit within the peripheral side wall such that the top cover is spaced above the bottom wall at a height equal to the upper edge of the peripheral side wall.

However, there are various problems associated with such conventional pizza boxes. In the first place, there are no vents in the boxes so that the boxes become very hot to handle.

Further, because of the heat and weight from the pizza pie, the bottom wall tends to sag. If many boxes are stacked one upon the other, as commonly occurs, the top cover of each box is in contact with the heated and sagging bottom wall, which results in sagging of the top cover, since there is no structural rigidity thereto.

Further, if the top cover sags, it may contact the upper cheese surface of the pizza pie. Accordingly, plastic protecting supports or tables have conventionally been positioned at the center of the pizza pie to prevent such occurrence. This, however, requires an additional piece, adding to the cost of packaging.

Still further, with such conventional pizza boxes, there is nothing to prevent sliding of the pizza pie up the sidewall of the boxes, so that the pizza pie curls over. Specifically, the side flaps of the top cover are of the same height as the side walls of the box. In other words, the pizza pies are freely positioned within the pizza boxes. Although the pizza boxes are generally dimensioned to be equal in width and depth to the diameter of the pizza pies, the pizza pies may still shift or slide therein such that the pizza pies ride up the side walls of the box and curl over.

In addition, there is generally no way to check the type of pizza pie in the box without lifting the entire cover, which is often burdensome because of space problems and which also results in the release of much of the heat from the pizza pie.

OBJECTS AND SUMMARY OF THE INVENTION

Accordingly, it is an object of the present invention to provide a pizza box that overcomes the aforementioned problems with the prior art.

More particularly, it is an object of the present invention to provide a pizza box that provides structural rigidity of the cover by reason of the inclined construction thereof, as a result of the fold lines and slits therein.

It is another object of the present invention to provide a pizza box in which the top cover, because of its structural rigidity, will not sag if many boxes are stacked one upon the other, thereby eliminating the need for a center plastic protecting support therein.

It is still another object of the present invention to provide a pizza box in which the fold lines and slits in the top cover form vents in the top cover which are always open.

It is yet another object of the present invention to provide a pizza box in which the cover, as a result of the fold lines and slits therein, is inclined upwardly so that the cover will not contact the upper cheese surface of the pizza pie, even if many boxes are stacked one upon the other.

It is a further object of the present invention to provide a pizza box in which the peripheral, downwardly extending side flaps of the cover will contact and hold down the pizza crust, thereby preventing or inhibiting sliding and curling over of the pizza pie.

It is a yet further object of the present invention to provide a pizza box in which the front flap can be opened, independently of the remainder of the cover to check the pizza pie, without lifting the entire cover.

In accordance with an aspect of the present invention, a box includes a bottom wall; a peripheral side wall attached to a periphery of the bottom wall; a top cover including a rear edge hingedly attached to the side wall, a front edge, two side edges between the front edge and the rear edge, two slits in the top cover, each slit extending from a front edge, side edge or corner to an inner point of the top cover, a first fold line interconnecting the inner points of the top cover to form a lift flap between the first fold line and the two slits, two second fold lines extending from the first fold line toward the rear edge, and the top cover being bent along the first and second fold lines such that the first fold line defines a high position of the top cover, and a vent opening is formed along each of the slits.

The top cover includes downwardly extending side flaps and a front flap which fit within the peripheral side wall, the flaps being of a lesser height than that of the peripheral side wall, such that the top cover is inclined upwardly from the flaps toward the first fold line. In addition, the front flap includes a tab for pulling up the lift flap about the first fold line.

Preferably, the item is a pizza pie with an outer peripheral crust, and lower edges of the side flaps and front flap are positioned on the bottom wall so that the cover at least inhibits sliding of the pizza pie within the box.

The first fold line is at a height substantially the same as an upper edge of the peripheral side wall when the top cover is closed.

The two second fold lines extend from the first fold line toward rear corners of the top cover to form two substantially triangular sections between each second fold line and a respective slit, and a rear section is formed between the first fold line and the two second fold lines. The triangular sections, the lift flap and the rear section extend downwardly away from the first fold line, such that the first fold line forms a highest position of the top cover.

In order to form the vent openings, side edges of the lift flap overlay adjacent side edges of respective triangular sections along each slit. Thus, the vent openings are always open.

The slits are not entirely linear. Thus, each slit includes a first slit section which is offset from a second slit section thereof.

Finally, a rear connecting panel connects the top cover to the peripheral side wall via a double hinge.

In accordance with another aspect of the present invention, a blank for forming a box, includes a bottom panel; two side panels attached to opposite sides of the bottom panel along respective side fold lines; a front panel attached to a front side of the bottom panel along a front fold line; a rear panel attached to a rear side of the bottom panel along a rear fold line; a top panel including a rear edge hingedly attached to the rear panel at a fold line opposite to the rear fold line, a front edge, two side edges between the front edge and the rear edge, two slits in the top cover, each slit extending from a front edge, side edge or corner to an inner point of the top cover, a first fold line interconnecting the inner points of the top cover, and two second fold lines extending from the first fold line toward the rear edge.

The top cover includes side flaps and a front flap of a lesser height than that of the peripheral side wall. The front flap includes a tab for pulling up the lift flap about the first fold line.

The two second fold lines extend from the hinge line toward rear corners of the top cover to form two substantially triangular sections between each second fold line and a respective slit, and a rear section is formed between the first fold line and the two second fold lines.

Further, the slits are not entirely linear. Thus, each slit includes a first slit section which is offset from a second slit section thereof.

The blank further includes a rear connecting panel which connects the top cover to the peripheral side wall via a double fold line formed by the rear edge of the top panel and the fold line of the rear panel which is opposite to the rear fold line thereof.

The above and other objects, features and advantages of the invention will become readily apparent from the following detailed description thereof which is to be read in connection with the accompanying drawings.

DETAILED DESCRIPTION OF THE PREFERRED EMBODIMENTS

Figure 4:
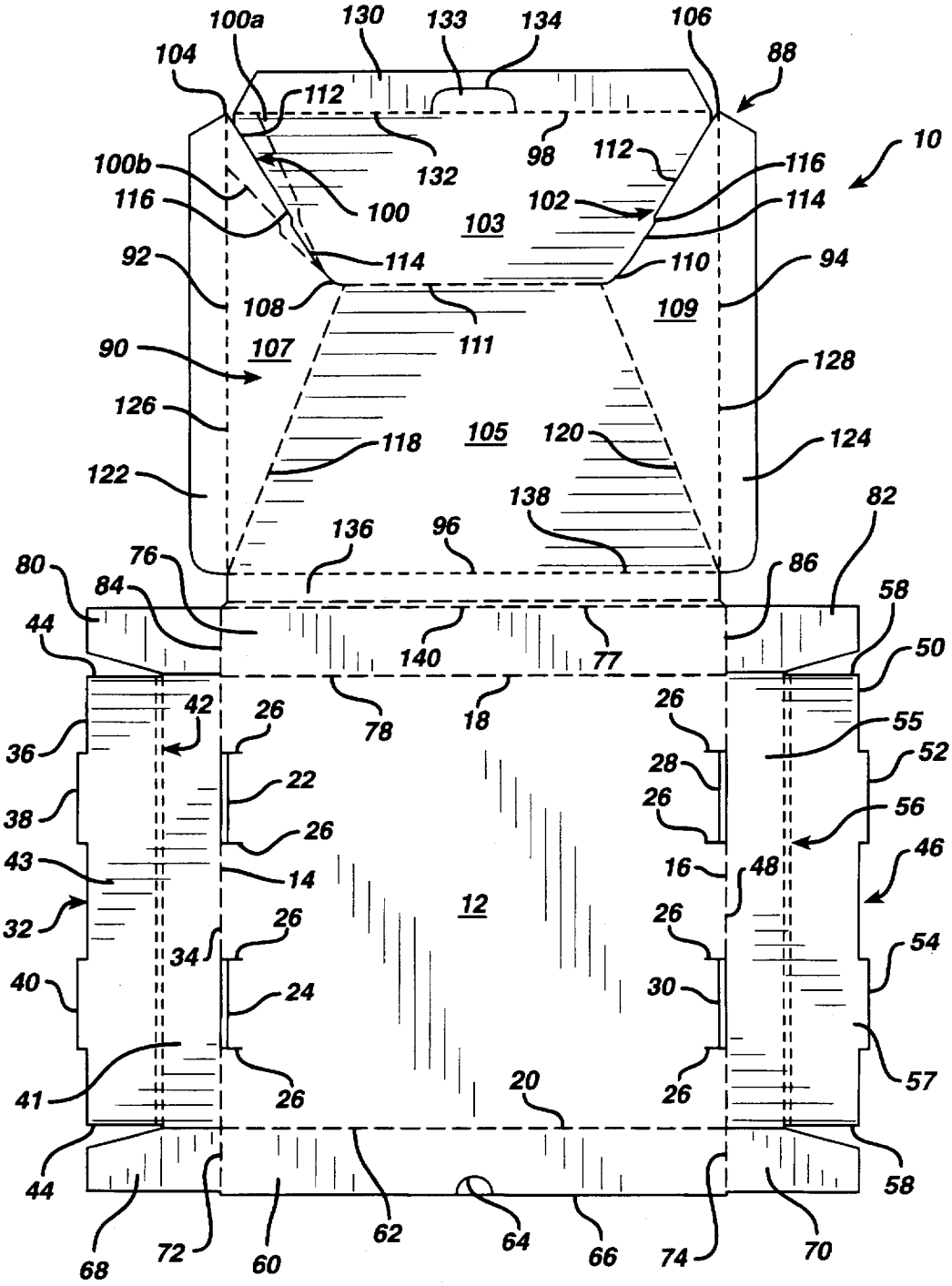
FIG. 4 a plan view of a blank used for forming the box of FIG. 1.

Referring to the drawings in detail, and initially to FIG. 4 thereof, a blank 10 for forming a pizza box 11 according to the present invention is formed from a single sheet of corrugated cardboard or chipboard material. Blank 10 includes a generally square bottom panel 12 which forms the bottom wall of the pizza box. Bottom panel (wall) 12 includes side edges 14 and 16, rear edge 18 and front edge 20. Two narrow rectangular cut-out areas 22 and 24 are formed along side edge 14 such that the lengthwise direction of cut-out areas 22 and 24 extends in the direction from rear edge 18 to front edge 20. One longer side of each cut-out area 22 and 24 is coincident with side edge 14. The shorter sides of cut-out areas 22 and 24 extend inwardly of bottom wall 12, past the respective opposite longer sides of cut-out areas 22 and 24 to form small slits 26. In like manner, similar cut-out areas 28 and 30 are formed along side edge 16 in a mirror image to cut-out areas 22 and 24. Cut-out areas 28 and 30 are also formed with slits 26.

Figure 1:
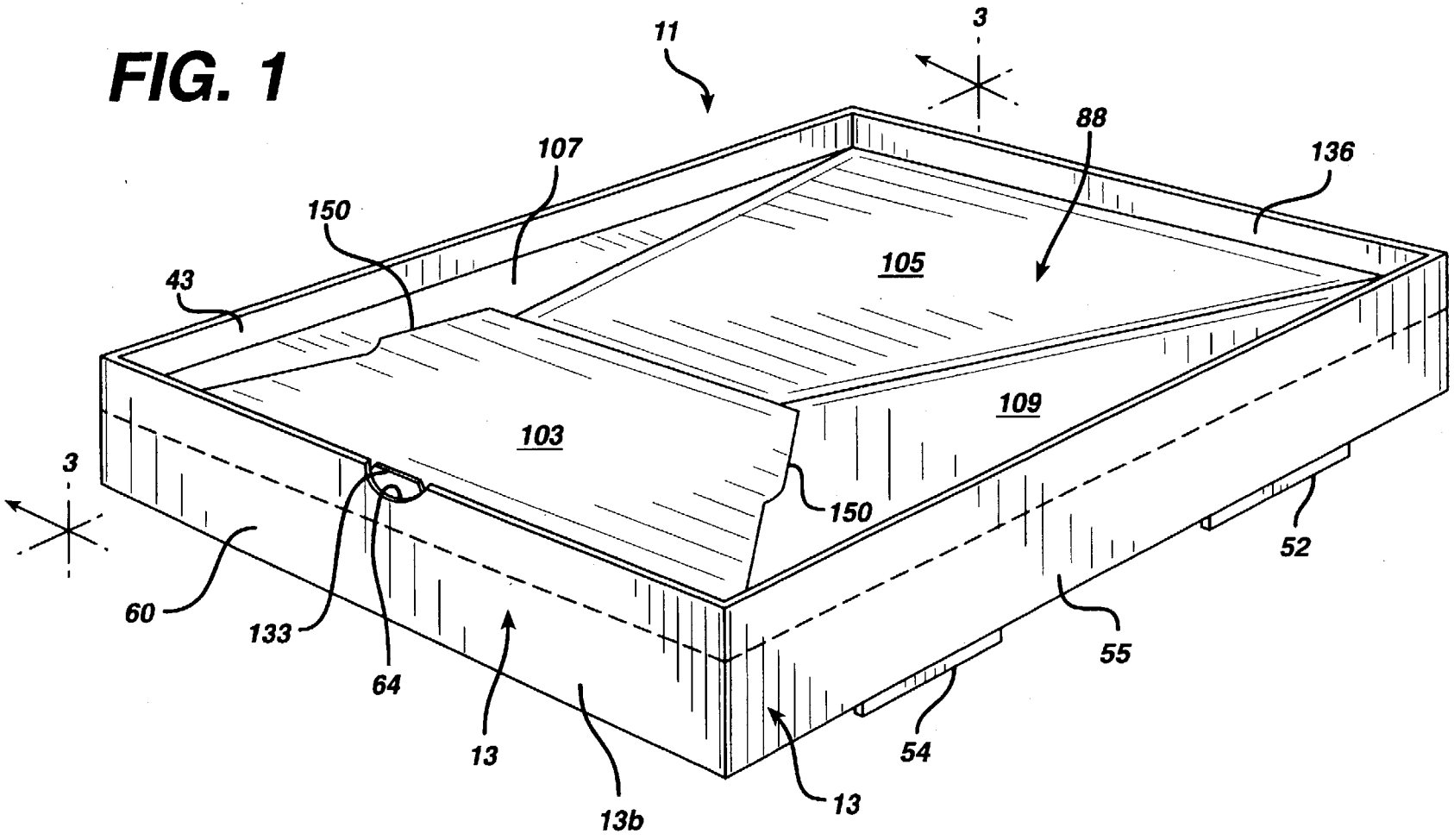
FIG. 1 is a perspective view of the box according to the present invention, with the top cover completely closed.
Figure 2:
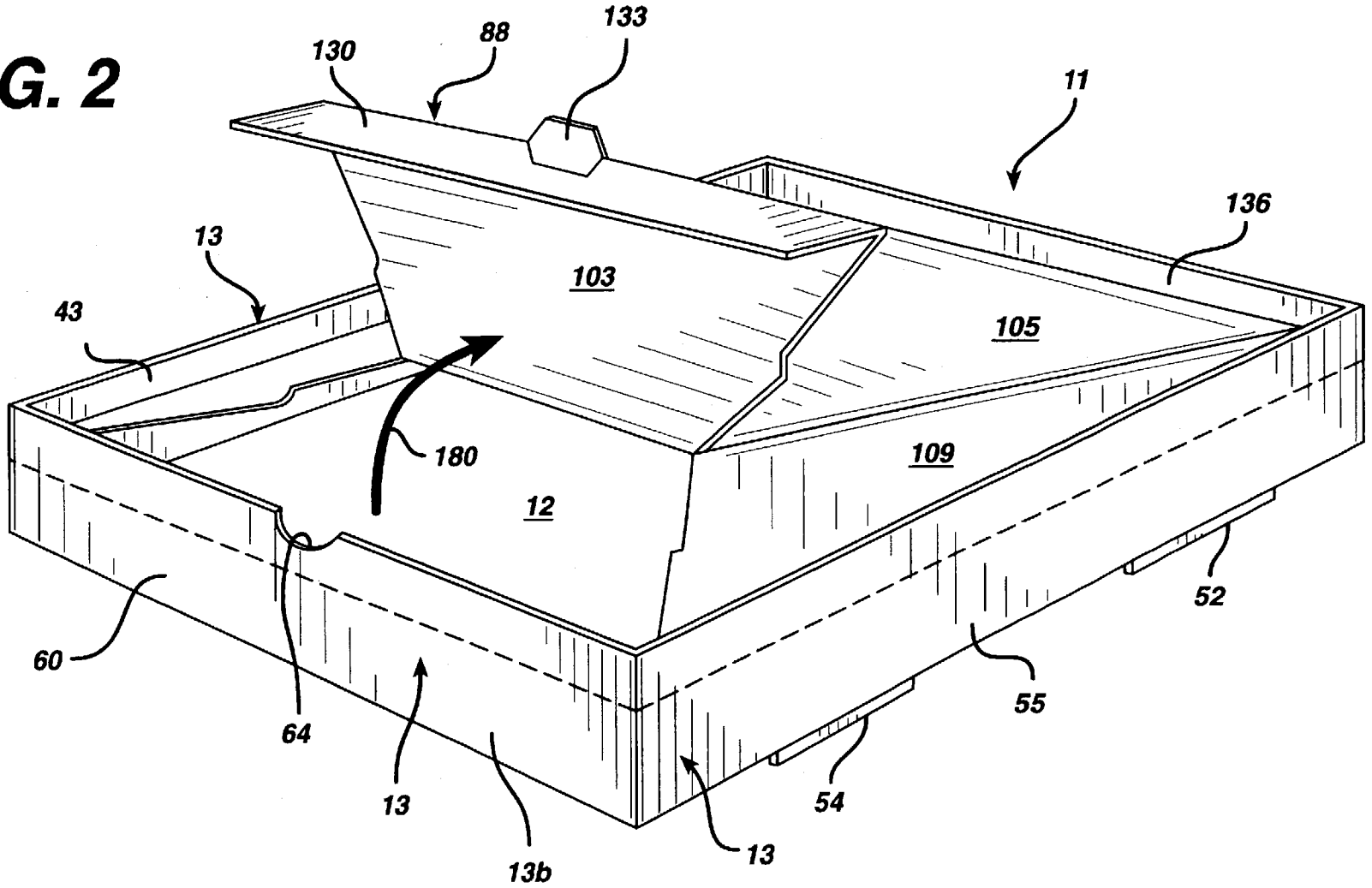
FIG. 2 is a perspective view of the box of FIG. 1, with the lift flap of the top cover open.
Figure 3:
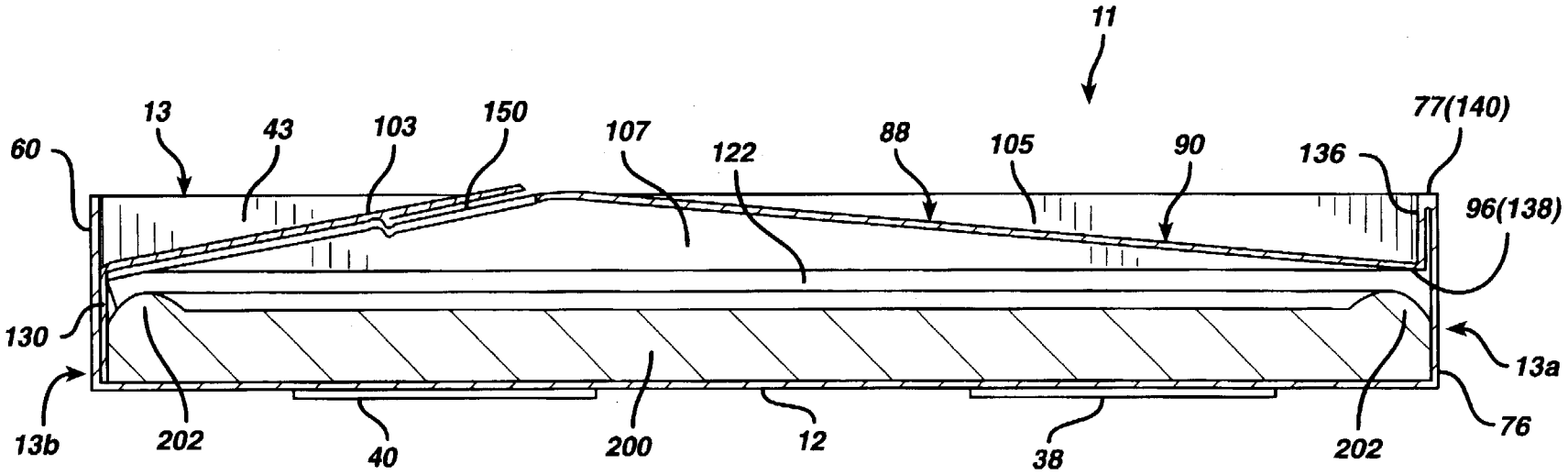
FIG. 3 is a cross-sectional view of the box of FIG. 1, taken along line 3—3 thereof.

A side panel 32 is connected to bottom panel 12 along side edge 14 and is of a generally rectangular configuration. The connecting line between bottom panel 12 and side panel 32 forms a fold line 34, that is, along side edge 14. The opposite, outer edge 36 of side panel 32 is formed with two spaced, shallow rectangular tabs 38 and 40 which are in alignment with cut-out areas 22 and 24. Side panel 32 includes a double fold line 42 extending in the lengthwise direction thereof, which substantially bisects side panel 32 into an inner section 41 and an outer section 43. Thus, when side panel 32 is folded along fold line 34, and along double fold line 42, sections 41 and 43 overlap each other and tabs 38 and 40 fit within cut-out areas 22 and 24. Tabs 38 and 40 extend to a position slightly below the lower surface of bottom panel 12, so that they can interlock within the peripheral side wall 13 of a lower box where there is a stacking relation. This prevents lateral shifting of stacked boxes 11, that is, to the left or right. Thus, side panel 32 forms part of the peripheral side wall 13 of pizza box 11, as shown in FIGS. 1–3. In this regard, slits 26 allow for some play in fitting tabs 38 and 40 into cut-out areas 22 and 24. In addition, the outer side edges 44 of outer section 43 of side panel 32 are slightly cut away to permit easy folding of side panel 32 with respect to the rear and front walls of pizza box 11, and thereby, to permit easier assembly of pizza box 11.

A side panel 46 is provided on the opposite side of bottom panel 12 and connected thereto. Side panel 46 is connected to bottom panel 12 along side edge 16 and is of a generally rectangular configuration. The connecting line between bottom panel 12 and side panel 46 forms a fold line 48, that is, along side edge 16. The opposite, outer edge 50 of side panel 46 is formed with two spaced, shallow rectangular tabs 52 and 54 which are in alignment with cut-out areas 28 and 30. Side panel 46 includes a double fold line 56 extending in the lengthwise direction thereof, which substantially bisects side panel 46 into an inner section 55 and an outer section 57. Thus, when side panel 46 is folded along fold line 48, and along double fold line 56, tabs 52 and 54 fit within cut-out areas 28 and 30. Tabs 52 and 54 extend to a position slightly below the lower surface of bottom panel 12, so that they can interlock within the peripheral side wall 13 of lower box where there is a stacking relation. Thus, side panel 46 also forms part of the peripheral side wall 13 of pizza box 11, as shown in FIGS. 1–3. In this regard, slits 26 allow for some play in fitting tabs 52 and 54 into cut-out areas 28 and 30. In addition, the outer side edges 58 of outer section 57 of side panel 46 are slightly cut away to permit easy folding of side panel 46 with respect to the rear and front walls **13*a* and 13*b* of pizza box 11, and thereby, to permit easier assembly of the pizza box. Rear wall 13*a* and front wall 13*b* form part of the peripheral side wall 13 of pizza box 11, as shown in FIGS. 1–3**.

A rectangular front panel 60 which is equal in width to front edge 20, and is equal in height to the height of each of inner sections 41 and 55, is connected to bottom panel 12 along front edge 20, which forms a fold line 62. In addition, a semi-circular cut-out 64 is provided centrally of the outer edge 66 of front panel 60, the purpose for which will become readily apparent from the discussion hereinafter. Side tabs 68 and 70 are connected to side edges of front panel 60 along fold lines 72 and 74, respectively.

When assembling pizza box 11, rear panel 60 is first folded upwardly along fold line 62 and side tabs 68 and 70 are folded inwardly along fold lines 72 and 74 such that side tabs 68 and 70 are substantially coincident with side edges 14 and 16 of bottom wall 12. Then, side panels 32 and 46 are folded upwardly along fold lines 34 and 48 such that the outer surfaces of side tabs 68 and 70 are positioned against the inner surfaces of inner sections 41 and 55 of side panels 32 and 46. Then, side panels 32 and 34 are folded about double fold lines 42 and 56, and tabs 38, 40, 52 and 54 are inserted within cut-out areas 22, 24, 28 and 30. As a result, side tabs 68 and 70 are trapped between sections 41, 43 and 55, 57, respectively, so as to hold front panel 60 in a raised position. In such case, front panel 60 forms front wall 13b which is part of the peripheral side wall 13 of the formed pizza box 11.

In like manner, a rectangular rear panel 76 is connected to rear edge 18 of bottom panel 12 which forms a fold line 78. Rear panel 76 is equal in width to rear edge 18, and is equal in height to the height of each of inner sections 41 and 55. Side tabs 80 and 82 are connected to side edges of rear panel 76 along fold lines 84 and 86, respectively.

When assembling the pizza box, rear panel 76 is first folded upwardly along fold line 78 and side tabs 80 and 82 are folded inwardly along fold lines 84 and 86 such that side tabs 80 and 82 are substantially coincident with side edges 14 and 16 of bottom wall 12. Then, side panels 32 and 46 are folded upwardly along fold lines 34 and 48 such that the outer surfaces of side tabs 80 and 82 are positioned against the inner surfaces of sections 41 and 55 of side panels 32 and 46. Then, side panels 32 and 46 are folded about double fold lines 42 and 56, and tabs 38, 40, 52 and 54 are inserted within cut-out areas 22, 24, 28 and 30. As a result, side tabs 80 and 82 are trapped between sections 41, 43 and 55, 57, respectively, so as to hold rear panel 76 in a raised position. In such case, rear panel 76 forms rear wall 13a which is part of the peripheral side wall 13 of the formed pizza box 11.

Blank 10 further includes a top cover 88. Top cover 88 includes a top panel 90 of a generally square configuration with side edges 92 and 94, rear edge 96 and front edge 98.

Top panel 90 further includes angled slits 100 and 102 which extend from opposite front corners 104 and 106, respectively, of top panel 90 to spaced internal points 108 and 110, respectively, of top panel 90. Internal points 108 and 110 are preferably positioned about one-third of the way from front edge 98 to rear edge 96, and about one-fifth of the way from the respective side edge 92 or 94 to the opposite side edge 94 or 92. Angled slits 100 and 102 are of equal length and are of equal, but opposite, angles, so as to be symmetrical. The line 111 connecting internal points 108 and 110 is a first fold line that is parallel to front edge 98. In addition, angled slits 100 and 102 are non-linear as a whole. Specifically, each angled slit 100 and 102 includes a first linear portion 112 which merges into a second linear potion 114 that is offset from the first linear portion 112 by a transition portion 116, such that first and second linear portions 112 and 114 are parallel but offset relative to each other.

It will be further appreciated that, although angled slits 100 and 102 terminate at front corners 104 and 106, respectively, angled slits 100 and 102 could just as easily terminate at front edge 98, as shown by dot-dash slit lines 100a in FIG. 4, offset from front corners 104 and 106, or terminate at side edges 92 and 94, as shown by dashed slit lines 100b in FIG. 4. It will be appreciated that, in the event that alternative slits 100a or 100b are used, similar symmetrical slits would be provided on the opposite side of top panel 90.

For purposes of the present invention, reference to the slits extending from at least one of (A) front edge 98 and (B) one side edge 92 or 94 to an inner point of top cover 88 will be meant to cover the embodiments where the slits terminate at front corners 104 and 106, front edge 98 or side edges 92 and 94.

As a result, a trapezoidal shaped lift flap 103 is formed between front edge 98, slits 100 and 102 and fold line 111.

Further, top panel 90 includes two angled second fold lines 118 and 120 which extend from fold line 111, at positions slightly inwardly of internal points 108 and 110, respectively, to rear corners of top panel 90, respectively.

As a result, a rear trapezoidal section 105 is formed between rear edge 96 and fold lines 111, 118 and 120. Further, a side triangular section 107 is formed between side edge 92, slit 100 and fold line 118, and a side triangular section 109 is formed between side edge 95, slit 102 and fold line 120.

Top cover 88 further includes side flaps 122 and 124 extending along the length of side edges 92 and 94, respectively, the latter which function as fold lines 126 and 128. In addition, a front flap 130 extends along the length of front edge 98, which functions as a fold line 132. The side edges of front flap 130 and the front edges of side flaps 122 and 124 can be beveled, as shown in FIG. 4. Further, the width of flaps 122, 124 and 130 is much less than the height of peripheral side wall 13 of pizza box 11, that is, much less in height than the height of sections 41 and 55 and front flap 60.

In addition, an arcuate slit 134 is formed in front flap 130 with opposite ends of arcuate slit 134 coincident with front edge 98 so that a pulling tab 133 is formed which can be pushed out from front flap 130 and folded along fold line 132.

Finally, top cover 88 includes a rear connecting panel 136 which connects rear edge 96 of top panel 90 to the outer edge 77 of rear panel 76 such that rear edge 96 functions as a fold line 138 and outer edge 77 functions as a fold line 140. In effect, a double hinge is provided by fold lines 138 and 140 for connecting top cover 88 to peripheral side wall 13 of pizza box 11.

With this arrangement, and assuming the assembly of side panels 32 and 46, front panel 60 and rear panel 76 with bottom panel 12 so as to form side peripheral wall 13 of pizza box 11, flaps 122, 124 and 130 are first turned by 90° about fold lines 126, 128 and 132. In such case, pulling tab 133 is pushed outwardly for grasping by a person. Then, rear connecting panel 136 is folded about fold line 77 so that it extends downwardly into the formed pizza box 11, as shown best in FIG. 3, and top panel 90 is folded in the opposite direction about fold line 138 so that it overlies and is spaced above bottom panel 12.

During the latter fold, flaps 122 and 124 are inserted within peripheral side wall 13 of pizza box 11 defined by panels 32 and 46, respectively. In such case, rear connecting panel 136 is forced rearwardly toward the inner surface of rear panel 76. Since the lengthwise dimension of top panel 90 is substantially the same as that of bottom panel 12, and because of the positioning of rear connecting panel 136 between rear edge 96 of top panel 90 and rear panel 76, there is a slight force fit of top panel 90, and particularly, triangular sections 107 and 109 thereof between front panel 60 and rear panel 76. In such case, rear connecting panel 76 functions as a spring to apply a force on cover 88. As a result, top panel 90 is bent along fold lines 118 and 120 which are forced upwardly to a raised position, starting from a lowest position at rear edge 96 and along fold lines 126 and 128, and rising to a highest position of top cover 88 at fold line 111. In other words, top panel 90 is bent along fold lines 118 and 120 so that triangular sections 107 and 109 slope downwardly therefrom.

It will be appreciated that, in this position, fold line 111 is at the highest position of top cover 88. When a pizza pie 200 is seated on bottom panel 12, as shown in FIG. 3, the lower edges of side flaps 122 and 124 rest on the upper surface of bottom wall 12. Because side flaps 122 and 124 are of a much lesser height than the peripheral side wall 13 of pizza box 11, the upper surface of the annular crust 202 of pizza pie 200 is positioned close to top cover 88 due to the dome arrangement thereof. This results in pizza pie 200 being retained in position so that it is prevented from sliding within pizza box 11, that is, from riding up the peripheral side wall 13 of pizza box 11 and curling over. In this position of top cover 88, fold line 111 is preferably at the same height as the upper edges of the peripheral side wall 13 of pizza box 11, thereby providing a center support in the event that another pizza box 11 is stacked thereon.

Further, because of the force fit of cover 88 and the spring action by rear connecting panel 136, top cover 88 is provided with greater rigidity against deformation thereof against forces applied downwardly thereon, for example, from a stack of pizza boxes 11.

Thereafter, lift flap 103 is hinged downwardly along fold line 111 so that lift flap 130 slides against the inner surface of front panel 60 to completely close top cover 88, except for vent openings 150 that are formed, as shown in FIGS. 1–3. Specifically, because of the angulation of triangular sections 107 and 109, and because lift flap 103 is thereafter closed, lift flap 103 slightly overlies triangular sections 107 and 109 at the location of slits 100 and 102, and particularly, at second linear portions 114 thereof. As a result, there is a slight gap therebetween which forms vent openings 150 that are always open. Vent openings 150 permit venting of steam more efficiently by directing steam to the highest point of pizza box 11 and releasing the steam at that highest point, while keeping the pizza pie covered from above.

Vent openings 150 function to release some of the heat to enable a person to carry pizza box 11 without fear of being burnt, and to also take heat away from top cover 88 to prevent the same from becoming moist and thereby weakening in structure of the material. It will be appreciated that vent openings 150 are always open to some extent.

When lift flap 103 is closed, pulling tab 133 extends upwardly and is positioned against the inner surface of front panel 60, and is in alignment with and accessible through semi-circular cut-out 64, as shown in FIG. 1. Thus, a person can grasp pulling tab 133 and pull it upwardly. This results in lift flap 103 pivoting upwardly about fold line 111 in the direction of arrow 180 in FIG. 2, in order for a person to check pizza pie 200 within pizza box 11. During this time, however, the remainder of top cover 88 is closed.

Thus, with the above construction, pizza box 11 is provided with a top cover 88 having enhanced structural rigidity. Specifically, top cover 88 will not sag if many boxes 11 are stacked one upon the other, thereby eliminating the need for a center plastic protecting support or table therein.

At the same time, the fold lines 118 and 120 and slits 100 and 102 which result in the enhanced structural rigidity of top cover 88, also forms vents 150 in top cover 88 which are always open.

Still further, as a result of fold lines 118 and 120 and slits 100 and 102 therein, top cover 88 is inclined upwardly so that top cover 88 will not contact the upper cheese surface of pizza pie 200, even if many boxes 11 are stacked one upon the other.

As a further advantage of the present invention, because of the inclined portions 103, 105, 107 and 109 of top cover 88, top cover 88 is at a lower position at the periphery thereof, so as to prevent or inhibit sliding of pizza pie 200 within box 11.

Lastly, as a result of fold lines 118 and 120 and slits 100 and 102 in top cover 88, lift flap 103 is formed which can be opened, independently of the remainder of cover 88 to check pizza pie 200, without lifting the entire cover 88, to examine the contents of box 11 without fully uncovering the entire pizza pie 200. This has a dual purpose. First, it can be used to inspect a pizza pie. Further, when a pizza pie 200 is packaged after cooking, lift flap 103 can remain in the raised position to allow steam to escape while completing the remainder of any order for delivery. Then, when the remainder of the order is ready for delivery, lift flap 103 is closed.

Further, although pizza box 11 has been described as formed from a one-piece blank 10, top cover 88 can be made separately therefrom and hingedly secured thereto by any suitable means.

It will be appreciated that, while the present invention has been described in relation to a pizza box for holding a pizza pie, the box according to the present invention may be used for holding other items. In such case, the dimensions of the box can be modified in accordance with the other items to be held.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention as defined by the appended claims.

What is claimed is:

1. A box comprising:

(a) a bottom wall;

(b) a peripheral side wall attached to a periphery of said bottom wall; and (c) a top cover including:

(i) a rear edge hingedly attached to said side wall, (ii) a front edge, (iii) two side edges between said front edge and said rear edge, (iv) two slits in said top cover, each slit extending from at least one of:

(A) said front edge, and (B) one said side edge to an inner point of said top cover, (v) a first fold line interconnecting said inner points of said top cover to form a lift flap between said first fold line and said two slits, (vi) two second fold lines extending from said first fold line toward said rear edge, and (vi) said top cover being bent along said first and second fold lines such that:

(A) said first fold line defines a high position of said top cover, and (B) a vent opening is formed along each of said slits.

2. A box according to claim 1, wherein said top cover includes downwardly extending side flaps and a front flap which fit within said peripheral side wall, said side flaps and front flap being of a lesser height than that of said peripheral side wall, such that said top cover is inclined upwardly from said side flaps and front flap toward said first fold line.

3. A box according to claim 2, wherein said item is a pizza pie with an outer peripheral crust, and lower edges of said side flaps and front flap are positioned on said bottom wall so that the cover at least inhibits sliding of said pizza pie within said box.

4. A box according to claim 2, wherein said front flap includes a tab for pulling up said lift flap about said first fold line.

5. A box according to claim 1, wherein said first fold line is at a height substantially the same as an upper edge of said peripheral side wall when said top cover is closed.

6. A box according to claim 1, wherein said vent openings are always open.

7. A box according to claim 1, wherein:

said two second fold lines extend from said first fold line toward rear corners of said top cover to form two substantially triangular sections between each said second fold line and a respective slit, and a rear section is formed between said first fold line and said two second fold lines.

8. A box according to claim 7, wherein said triangular sections, said lift flap and said rear section extend downwardly away from said first fold line, such that said first fold line forms a highest position of said top cover.

9. A box according to claim 1, wherein:

side edges of said lift flap overlay adjacent side edges of respective said triangular sections along each slit to form the vent openings.

10. A box according to claim 1, wherein said slits are not entirely linear.

11. A box according to claim 10, wherein each said slit includes a first slit section which is offset from a second slit section thereof.

12. A box according to claim 1, further comprising a rear connecting panel which connects said top cover to said peripheral side wall via a double hinge.

13. A box according to claim 1, wherein said peripheral side wall is formed with tabs extending through and below a lower surface of said bottom wall for engagement within a peripheral side wall of a second box on which the first-mentioned box is stacked to prevent lateral sliding of the boxes relative to each other.

14. A blank for forming a box, comprising:

(a) a bottom panel;

(b) two side panels attached to opposite sides of said bottom panel along respective side fold lines;

(c) a front panel attached to a front side of said bottom panel along a front fold line;

(d) a rear panel attached to a rear side of said bottom panel along a rear fold line; and (e) a top panel including:

(i) a rear edge hingedly attached to said rear panel at a fold line opposite to said rear fold line, (ii) a front edge, (iii) two side edges between said front edge and said rear edge, (iv) two slits in said top cover, each slit extending from at least one of:

(A) said front edge, and (B) one said side edge to an inner point of said top cover, (v) a first fold line interconnecting said inner points of said top cover, and (vi) two second fold lines extending from said first fold line toward said rear edge.

15. A blank according to claim 14, wherein said top cover includes side flaps and a front flap of a lesser height than that of said peripheral side wall.

16. A box according to claim 15, wherein said front flap includes a tab for pulling up said lift flap about said first fold line.

17. A blank according to claim 14, wherein:

said two second fold lines extend from said first fold line toward rear corners of said top cover to form two substantially triangular sections between each said second fold line and a respective slit, and a rear section is formed between said first fold line and said two second fold lines.

18. A blank according to claim 14, wherein said slits are not entirely linear.

19. A blank according to claim 18, wherein each said slit includes a first slit section which is offset from a second slit section thereof.

20. A blank according to claim 14, further comprising a rear connecting panel which connects said top cover to said peripheral side wall via a double fold line formed by the rear edge of the top panel and the fold line of the rear panel which is opposite to the rear fold line thereof.

* * * * *